US009938796B2

(12) United States Patent
Hansen et al.

(10) Patent No.: US 9,938,796 B2
(45) Date of Patent: Apr. 10, 2018

(54) SEALING DEVICE AND METHOD FOR SEALING FRACTURES OR LEAKS IN WALL OR FORMATION SURROUNDING TUBE-SHAPED CHANNEL

(71) Applicants: Maersk Olie og Gas A/S, Copenhagen K (DK); Danmarks Tekniske Universitet, Kgs. Lyngby (DK)

(72) Inventors: Jens Henrik Hansen, Doha (QA); Anne Ladegaard Skov, Frederiksberg (DK)

(73) Assignee: MAERSK OLIE OG GAS A/S, Copenhagen O (DK)

( * ) Notice: Subject to any disclaimer, the term of this patent is extended or adjusted under 35 U.S.C. 154(b) by 390 days.

(21) Appl. No.: 14/648,588

(22) PCT Filed: Nov. 27, 2013

(86) PCT No.: PCT/EP2013/074861
§ 371 (c)(1),
(2) Date: May 29, 2015

(87) PCT Pub. No.: WO2014/083057
PCT Pub. Date: Jun. 5, 2014

(65) Prior Publication Data

US 2015/0308220 A1 Oct. 29, 2015

(30) Foreign Application Priority Data

Nov. 30, 2012 (EP) ..... 12194965

(51) Int. Cl.
*E21B 21/00* (2006.01)
*E21B 33/13* (2006.01)
(Continued)

(52) U.S. Cl.
CPC ..... *E21B 33/13* (2013.01); *E21B 21/00* (2013.01); *E21B 33/124* (2013.01); *E21B 33/138* (2013.01)

(58) Field of Classification Search
CPC ..... E21B 27/02; E21B 33/138; E21B 21/00; E21B 33/124; E21B 33/1243; E21B 33/13; C09K 8/42
See application file for complete search history.

(56) References Cited

U.S. PATENT DOCUMENTS 4,768,593 A 9/1988 Novak
6,955,216 B1 10/2005 Heijnen et al.
(Continued)

FOREIGN PATENT DOCUMENTS

EP 1426551 A1 6/2004
WO 2005085587 A2 9/2005

OTHER PUBLICATIONS

Search report for European Application No. 2738349, completed Jun. 4, 2013.
(Continued)

*Primary Examiner* — Daniel P Stephenson
(74) *Attorney, Agent, or Firm* — Brinks Gilson & Lione

(57) ABSTRACT

The sealing device (1) includes an elongated body (5) adapted to be introduced into a tube-shaped channel (2) and including a sealing fluid placement section (6) arranged between a first and a second annular flow barrier (7, 8). The elongated body further includes a sealing fluid activation section (11) arranged between the second annular flow barrier (8) and a third annular flow barrier (12) and including a sealing fluid activation device (13) adapted to at least initiate or accelerate curing of the sealing fluid (17). In operation, the elongated body may be displaced along the tube-shaped channel until the sealing fluid activation section is placed at a position where sealing fluid has been ejected
(Continued)

Figure 1:
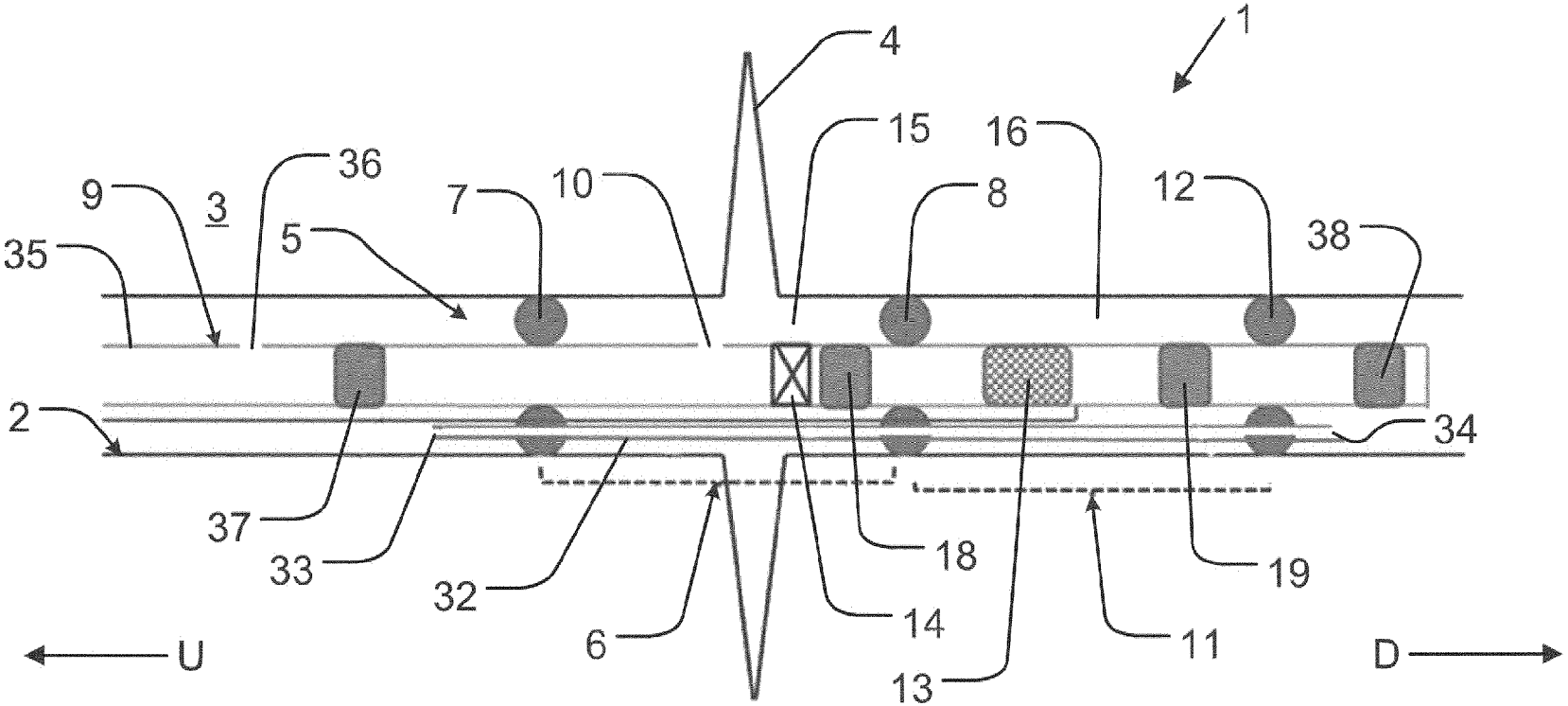

by the sealing fluid placement section, and the sealing fluid activation device may be activated. Thereby, sealing fluid may be cured at selected locations along the tube-shaped channel after ejection of sealing fluid.

20 Claims, 5 Drawing Sheets

(51) Int. Cl.
*E21B 33/124* (2006.01)
*E21B 33/138* (2006.01)

(56) References Cited

U.S. PATENT DOCUMENTS

| | | | | |
|---|---|---|---|---|
| 8,245,783 | B2 | 8/2012 | Lewis et al. | |
| 2004/0108112 | A1 | 6/2004 | Nguyen et al. | |
| 2005/0194190 | A1 | 9/2005 | Becker et al. | |
| 2009/0260818 | A1* | 10/2009 | Daniel | E21B 33/138 166/288 |
| 2010/0044042 | A1* | 2/2010 | Carter, Jr. | B09B 1/00 166/288 |
| 2011/0220359 | A1* | 9/2011 | Soliman | C09K 8/88 166/305.1 |
| 2014/0209298 | A1* | 7/2014 | Baldasaro | E21B 33/13 166/247 |
| 2015/0308220 | A1* | 10/2015 | Hansen | E21B 33/124 166/277 |
| 2015/0308221 | A1* | 10/2015 | Skov | C09K 8/512 166/292 |

OTHER PUBLICATIONS

International Preliminary Report on Patentability for PCT/EP2013/074861, dated Jun. 2, 2015.
International Search Report and Written Opinion for PCT/EP2013/074861, dated Mar. 11, 2014.

* cited by examiner

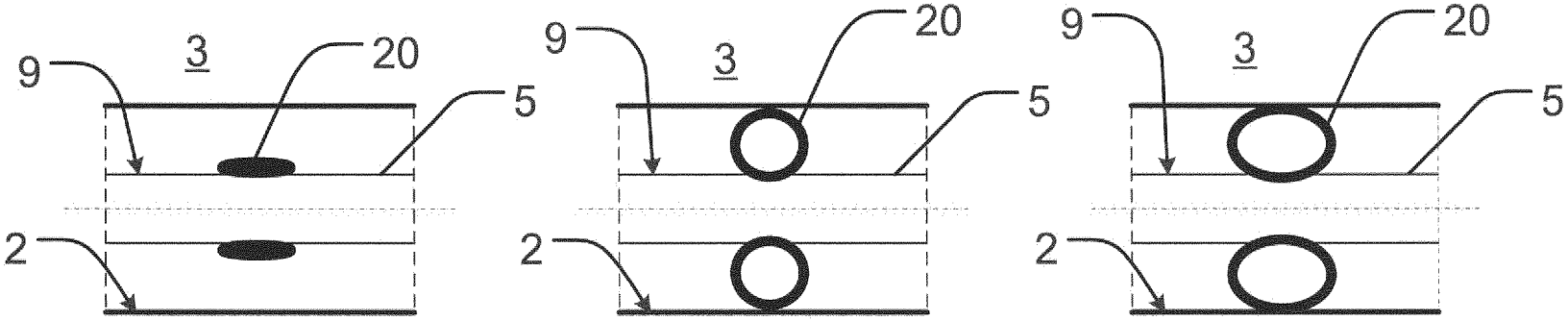
Fig. 4
Fig. 5
Fig. 6
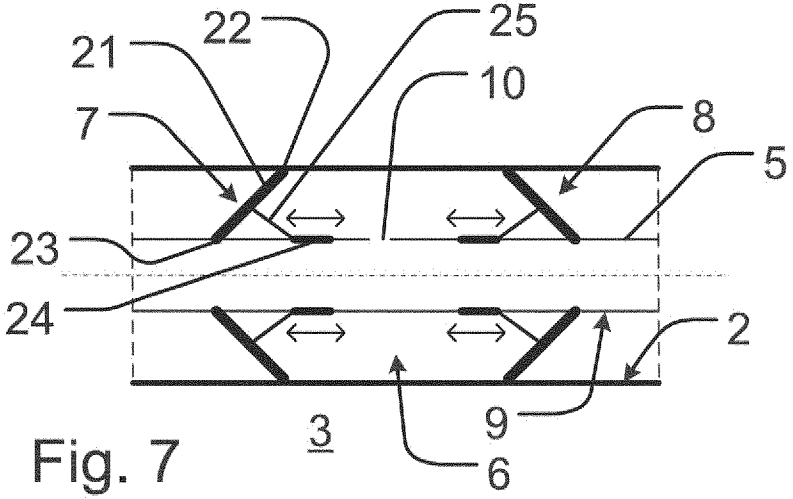
Fig. 7
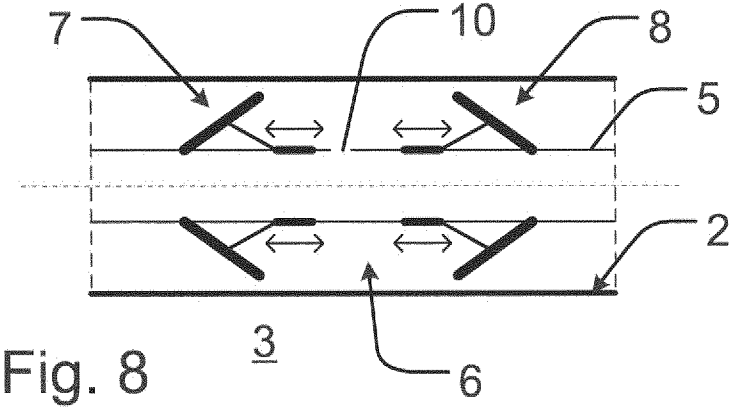
Fig. 8

SEALING DEVICE AND METHOD FOR SEALING FRACTURES OR LEAKS IN WALL OR FORMATION SURROUNDING TUBE-SHAPED CHANNEL

RELATED APPLICATIONS

This application claims the benefit under 35 U.S.C. § 371 of International Patent Application No. PCT/EP2013/074861, having an international filing date of Nov. 27, 2013, which claims priority to European Application No. 12194965.5, filed Nov. 30, 2012, the contents of all of which are incorporated herein by reference in their entirety.

BACKGROUND OF THE INVENTION

Field of the Invention

The present invention relates to a sealing device for sealing fractures or leaks in a wall or formation surrounding a tube-shaped channel, such as a drain, pipeline or well bore.

Description of Related Art

U.S. Pat. No. 6,955,216 B1 discloses a device for injecting a fluid into an earth formation surrounding a wellbore. For example, such injection is desirable in order to seal-off a formation, or a natural or induced fracture in a formation, around a perforated well tubular in the wellbore. The device is suitable to be arranged in the wellbore and is provided with a pair of inflatable packers arranged to isolate a portion of the wellbore between the packers from the remainder of the wellbore upon inflation of the packers. The device is further provided with an outlet port located between the packers for flow of sealing fluid from a fluid chamber to outside the device and means for inflating the packers. However, in practice, the device must be left in place in the well bore until the sealing fluid has set, as cross flow in the well bore may otherwise wash away the sealing fluid. When the device is to be removed, the set sealing fluid may render the removal of the device difficult and may prevent subsequent activation of the inflatable packers. Furthermore, if sealing fluid leaks from the isolated portion of the wellbore between the packers to the remaining part of the wellbore, the sealing fluid will set there and may be difficult to remove again. Furthermore, in the latter case, the sealing fluid pressure obtained in the section of the wellbore to be treated may have been too low with the result that fractures or leaks to be sealed have not been sufficiently deeply penetrated by sealing fluid before the sealing fluid starts curing. This may result in a situation wherein said fractures or leaks are insufficiently sealed so that the sealing effect may be too weak. However, as the entrance of said fractures or leaks is in fact sealed, it may be difficult or even impossible to provide a deeper seal at a subsequent treatment.

U.S. Pat. No. 8,245,783 B2 discloses a method of cementing in a well bore, whereby a casing is suspended from a wellhead to the bottom of the well bore, and whereby an annulus defined between the casing and the wellbore is filled with a cement composition. The cement composition may include a hydraulic cement and a sufficient amount of water to form a slurry, whereby a desired amount of an accelerator or oxidizing agent is added to the slurry. The slurry is subjected to ionizing radiation after placement of the slurry into the wellbore. The accelerator or oxidizing agent of the invention may be combined with a polymeric component serving to prevent the release of the accelerator or oxidizing agent into the cement slurry. The ionizing radiation introduced is sufficient to dissolve, degrade, or otherwise break down, the polymeric component thus allowing the accelerator or oxidizing agent to be released into the cement slurry. Once the accelerator or oxidizing agent is released, it is dispersed into the cement slurry and reacts with the slurry or a retarder, resulting in the initiation of the setting process. The ionizing radiation may be introduced by an ionizing radiation emitter located at a point within the wellbore or it may be located at the surface introducing the ionizing radiation directed downward into the wellbore. Furthermore, a radiation source may be lowered into the wellbore, such as on a wire line, and the ionizing radiation may be emitted. The radiation emitter can emit ionizing radiation as it is lowered down the wellbore and as it is pulled up the length of the wellbore. However, this method is directed at cementing a well bore in its entire length and is not suitable for the sealing of fractures or leaks in a selected part of a well bore or the like.

BRIEF SUMMARY OF THE INVENTION

The object of the present invention is to facilitate the sealing of fractures or leaks along a selected part of a tube-shaped channel.

In view of this object, the elongated body includes a sealing fluid activation section arranged between the second annular flow barrier and a third annular flow barrier adapted to extend from a circumference of the elongated body to the wall or formation surrounding the tube-shaped channel, and the sealing fluid activation section includes a sealing fluid activation device adapted to at least initiate or accelerate curing of the sealing fluid.

In this way, sealing fluid may be ejected by the sealing fluid placement section, the sealing fluid placement section may be displaced away from the sealing fluid to be cured, whereby surplus sealing fluid may be displaced or scraped away from the wall or formation surrounding the tube-shaped channel by means of the second annular flow barrier, and curing of the sealing fluid may be initiated or accelerated after checking that the sealing fluid has been correctly placed. Thereby it may be avoided that the sealing device is stuck in the tube-shaped channel due to curing of surplus sealing fluid in the sealing fluid placement section or due to curing of sealing fluid leaking from the sealing fluid placement section. Furthermore, it may be avoided that sealing fluid starts curing or starts substantial curing before it has been ensured that sufficient sealing fluid pressure has been applied and thereby that fractures or leaks have been sufficiently deeply penetrated by sealing fluid.

In an embodiment, the first, second and third annular flow barriers are adapted to at least partly seal the respective circumference of the elongated body against the wall or formation surrounding the tube-shaped channel. Thereby, sealing fluid having even a relatively low viscosity may be applied without leaking outside the sections of the tube-shaped channel isolated by means of the annular flow barriers. Furthermore, it may be effectively prevented that cross flow in the tube-shaped channel washes away the sealing fluid before it has cured.

In an embodiment, the sealing fluid activation device is adapted to at least initiate curing of the sealing fluid by means of irradiation. Thereby, it may be possible to delay curing or at least substantial curing of the sealing fluid until the sealing fluid has penetrated the fractures or leaks to be sealed. By means of irradiation, in this way, the sealing fluid may be cured sufficiently deeply into the fractures or leaks.

Therefore, the flow of the sealing fluid into the fractures or leaks may be facilitated as an initial low viscosity of the sealing fluid may be preserved until curing is started by the irradiation of the sealing fluid.

In an embodiment, the sealing fluid activation device is adapted to at least initiate curing of the sealing fluid by means of thermal irradiation. Thermal irradiation may penetrate relatively deeply into the wall or formation surrounding the tube-shaped channel, in fact deeper than for instance electromagnetic or particle radiation; however, the heating process may also take relatively long time.

In an embodiment, the sealing fluid activation device is adapted to at least initiate curing of the sealing fluid by means of electromagnetic or particle radiation. The effect of activation by means of particle radiation may reach sufficiently far inside the wall or formation surrounding the tube-shaped channel, but above all, the effect may be applied relatively fast compared to for instance the effect of activation by means of thermal radiation. Therefore, the fractures or leaks may be sealed relatively fast and sufficiently deep inside the wall or formation surrounding the tube-shaped channel.

The sealing fluid activation device may include a neutron accelerator adapted to cause secondary gamma radiation in the wall or formation surrounding the tube-shaped channel. Thereby, the activation device may be activated simply by means of supplying an electric current. Any other source of radiation that may be switched on electrically may be of operational advantage.

A plug or seal adapted to shield against radiation may be positioned in the elongated body of the sealing device in an area at the transition between the sealing fluid placement section and the sealing fluid activation section. Thereby, it may be avoided that sealing fluid in the placement section is activated by irradiation. Furthermore, it may be avoided that sealing fluid flows from the placement section to the activation section inside the elongated body of the sealing device.

In an embodiment, the sealing fluid activation device includes an outlet opening for an activation fluid, and the sealing fluid activation device is adapted to at least initiate curing of the sealing fluid by ejection of said activation fluid. Thereby, as in the embodiments mentioned above, it may be possible to at least initiate curing of the sealing fluid at selected locations along the tube-shaped channel after ejection of the sealing fluid and after checking that the placement of the sealing fluid has been performed satisfactorily. How deeply into the fractures or leaks to be sealed that the sealing fluid may be activated in this way may depend on, among other things, the viscosity of the sealing fluid and the activation fluid and the pressure applied during ejection of the activation fluid.

In an embodiment, at least one of the annular flow barriers includes an expandable seal. Thereby, the expandable seal may be retracted during introduction of the elongated body into the tube-shaped channel, thereby facilitating displacement, and it may be expanded during placement of sealing fluid in order to avoid escape of sealing fluid across the expandable seal.

The expandable seal may be in the form of a hollow elastic ring adapted to be inflated by an inflation fluid. Thereby, the degree of expansion of the expandable seal and the expansion force applied to the expandable seal may easily be controlled by means of controlling the pressure of the inflation fluid.

In an embodiment, the expandable seal is adapted to be transformable between a first, retracted configuration, a second expanded configuration, and a third expanded configuration, in both the second and third expanded configurations, the expandable seal extends further away from the circumference of the elongated body than it does in the retracted configuration, and the sealing device is adapted to apply a greater expansion force to the expandable seal in the third expanded configuration than in the second expanded configuration. Thereby, during introduction of the elongated body into the tube-shaped channel the expandable seal may adopt the first, retracted configuration so that the elongated body may be easily displaceable in the tube-shaped channel. During ejection of the sealing fluid, the expandable seal may adopt the third expanded configuration so that the expandable seal may suitably seal a circumference of the elongated body against the wall or formation surrounding the tube-shaped channel in order to avoid escape of sealing fluid to the remaining part of the tube-shaped channel. Subsequently to ejecting the sealing fluid into the tube-shaped channel and before curing the sealing fluid, during displacement of the elongated body along the tube-shaped channel, the expandable seal may adopt the second expanded configuration so that the expandable seal may scrape along the wall or formation surrounding the tube-shaped channel in order to remove surplus sealing fluid.

In an embodiment, at least one of the annular flow barriers includes an elastic flange extending out from a circumference of the elongated body and having a radially outer edge adapted to scrape against the wall or formation surrounding the tube-shaped channel. Thereby, the annular flow barrier may elastically adapt to different diameters of the tube-shaped channel in order to seal the circumference of the elongated body against the wall or formation surrounding the tube-shaped channel. Furthermore, the elastic flange may scrape against said wall or formation in order to remove surplus sealing fluid after ejection of sealing fluid.

Preferably, seen in an axial section, the elastic flange extends in an oblique direction in relation to the longitudinal direction of the elongated body of the sealing device. Thereby, the elastic flange may function like a one-way valve, whereby a pressure difference in a certain direction over the elastic flange may result in that the elastic flange bends slightly and opens for flow, and whereby a pressure difference in the opposite direction over the elastic flange may result in that the elastic flange is forced even more against the wall or formation surrounding the tube-shaped channel and therefore seals even better.

In an embodiment, at least one of the annular flow barriers includes two elastic flanges each extending out from a circumference of the elongated body in an oblique direction in relation to the longitudinal direction of the elongated body of the sealing device, the two elastic flanges have radially outer edges positioned against each other so that the two elastic flanges are reversed in relation to each other, and said radially outer edges of the two elastic flanges are adapted to scrape against the wall or formation surrounding the tube-shaped channel. Thereby, the two elastic flanges may seal against the wall or formation surrounding the tube-shaped channel independently of the direction of a pressure difference over the elastic flange.

In an embodiment, the radially outer edge of the elastic flange is adjustable between a retracted position and an expanded position, preferably by means of a slider displaceable in the longitudinal direction of the elongated body and connected to the elastic flange. Thereby, the expandable seal may be retracted during introduction of the elongated body into the tube-shaped channel, thereby facilitating displacement, and it may be expanded during placement of sealing fluid in order to avoid escape of sealing fluid across the expandable seal. Furthermore, the expansion force applied to the expandable seal may easily be controlled by adjusting said slider.

In an embodiment, the elongated body includes a cross flow shunt tube having a first end opening positioned outside the first annular flow barrier in relation to the sealing fluid placement section and a second end opening positioned outside the third annular flow barrier in relation to the sealing fluid activation section. Thereby, it may be avoided that cross flow in the tube-shaped channel substantially affects the sealing operation.

In an embodiment, the sealing fluid placement section includes a pressure gauge and preferably a temperature gauge arranged between the first and second annular flow barriers. Thereby, placement of the sealing fluid may be surveilled in order to ensure that curing is not initiated before the sealing fluid is correctly placed.

Preferably, the sealing fluid activation section includes a pressure gauge and preferably also a temperature gauge arranged between the second and third annular flow barriers. Thereby, in combination with the pressure gauge and/or temperature gauge in the sealing fluid placement section, in particular the function of second annular flow barrier may be surveilled.

Preferably, a pressure gauge and preferably also a temperature gauge is/are arranged outside the first annular flow barrier in relation to the sealing fluid placement section. Thereby, in combination with the pressure gauge and/or temperature gauge in the sealing fluid placement section, in particular the function of the first annular flow barrier may be surveilled.

Preferably, a pressure gauge and preferably also a temperature gauge is/are arranged outside the third annular flow barrier in relation to the sealing fluid activation section. Thereby, in combination with the pressure gauge and/or temperature gauge in the sealing fluid activation section, in particular the function of the third annular flow barrier may be surveilled.

In an embodiment, the elongated body of the sealing device includes a recirculation port positioned outside the part of the elongated body isolated by the first and third annular flow barriers, and the recirculation port is adapted for recirculation of fluids including sealing fluid through the tube-shaped channel. For instance, fluid may be recirculated to surface in a well. Thereby, for instance, a tubing running into the tube-shaped channel 2 for the supply of sealing fluid may be emptied of drilling mud or the like before injection of sealing fluid so that it may be avoided that said drilling mud or the like is injected into fractures or leaks to be sealed. Furthermore, a section of the tube-shaped channel may be treated two or more times by a sequence including sealing fluid ejection and subsequent sealing fluid activation, whereby in between or before said sequences, the tube-shaped channel may be flushed by means of a fluid suitable to remove loose solid parts.

The present invention further relates to a method for sealing fractures or leaks in a wall or formation surrounding a tube-shaped channel, such as a drain, pipeline or well bore, whereby an elongated body having a longitudinal direction is introduced into the tube-shaped channel, whereby a sealing fluid placement section of the elongated body is arranged between a first and a second annular flow barrier extending from a circumference of the elongated body to the wall or formation surrounding the tube-shaped channel, and whereby sealing fluid is ejected from the sealing fluid placement section through a sealing fluid outlet port into the tube-shaped channel.

The method is characterised by that a sealing fluid activation section is arranged between the second annular flow barrier and a third annular flow barrier extending from a circumference of the elongated body to the wall or formation surrounding the tube-shaped channel, by that the elongated body is displaced along the tube-shaped channel until the sealing fluid activation section of the elongated body is placed at a position where sealing fluid has been ejected by the sealing fluid placement section, and by that a sealing fluid activation device of the sealing fluid activation section is activated, whereby curing of the ejected sealing fluid is at least initiated or accelerated, preferably by means of irradiation of the sealing fluid (17). Thereby, the features discussed above may be obtained.

In an embodiment, the first, second and third annular flow barriers are at least partly sealing the respective circumferences of the elongated body against the wall or formation surrounding the tube-shaped channel. Thereby, the features discussed above may be obtained.

In an embodiment, before initiation or acceleration of the curing of the ejected sealing fluid, the elongated body is displaced along the tube-shaped channel until the sealing fluid activation section of the elongated body is placed at the position where the sealing fluid placement section was placed during ejection of the sealing fluid. Thereby, it may be possible to delay curing or substantial curing of the sealing fluid until the sealing fluid has penetrated the fractures or leaks to be sealed. Therefore, the flow of the sealing fluid into the fractures or leaks may be facilitated as an initial low viscosity of the sealing fluid may be preserved until curing is started by means of the sealing fluid activation section. Furthermore, surplus sealing fluid may easier be scraped away from the wall or formation surrounding the tube-shaped channel by means of the second annular flow barrier, and it may be even better avoided that the sealing device gets stuck in the tube-shaped channel due to curing of surplus sealing fluid in the sealing fluid placement section or due to curing of sealing fluid leaking from the sealing fluid placement section.

Preferably, curing of the ejected sealing fluid is at least almost finished before the sealing fluid activation section of the elongated body is removed from the position where the sealing fluid placement section was placed during ejection of the sealing fluid. Thereby, it may be even better avoided that cross flow in the tube-shaped channel washes away the sealing fluid before it has been cured.

In an embodiment, the elongated body is displaced along the tube-shaped channel in a stepwise manner in such a way that in a first step, the elongated body is displaced to a certain position along the tube-shaped channel and arrested there during ejection of sealing fluid into the tube-shaped channel, and in a second step, the elongated body is displaced to another position along the tube-shaped channel and arrested there during activation by means of the sealing fluid activation section of the sealing fluid that has been ejected by the sealing fluid placement section, and these two steps are repeated several times. Thereby, fractures or leaks at several local positions along the tube-shaped channel may be sealed effectively. Placement of the sealing fluid may be controlled to a large extent before curing is even initiated so that curing of sealing fluid that has not been correctly placed may effectively be avoided.

In an embodiment, at least one of the annular flow barriers includes an expandable seal adapted to be inflated by an inflation fluid, during introduction of the elongated body into the tube-shaped channel and during displacement of the elongated body until the sealing fluid placement section of the elongated body is placed at a position where sealing fluid is to be ejected, the pressure of the inflation fluid is maintained below a first inflation pressure so that the expandable seal adopts a first, retracted configuration, subsequently to ejecting the sealing fluid into the tube-shaped channel, during displacement of the elongated body along the tube-shaped channel until the sealing fluid activation section of the elongated body is placed at a position where sealing fluid has been ejected by the sealing fluid placement section, the pressure of the inflation fluid is maintained above a second inflation pressure greater than the first inflation pressure so that the expandable seal adopts a second expanded configuration so that the expandable seal scrapes along the wall or formation surrounding the tube-shaped channel, and, at least during ejection of the sealing fluid, the pressure of the inflation fluid is maintained above a third inflation pressure greater than the second inflation pressure so that the expandable seal adopts a third expanded configuration in which the expandable seal seals a circumference of the elongated body against the wall or formation surrounding the tube-shaped channel to a greater extent than when the expandable seal adopts the second expanded configuration. Thereby, during introduction of the elongated body into the tube-shaped channel the elongated body may be easily displaceable. During ejection of the sealing fluid, the expandable seal may suitably seal the circumference of the elongated body against the wall or formation surrounding the tube-shaped channel in order to avoid escape of sealing fluid to the remaining part of the tube-shaped channel. Subsequently to ejecting the sealing fluid into the tube-shaped channel and before curing the sealing fluid, during displacement of the elongated body along the tube-shaped channel, the expandable seal may remove surplus sealing fluid.

In an embodiment, the elongated body is displaced along the tube-shaped channel in a continuous manner during ejection of sealing fluid into the tube-shaped channel by means of the sealing fluid placement section and during simultaneous activation by means of the sealing fluid activation section of sealing fluid previously ejected by the sealing fluid placement section. Thereby, lining of a continuous section of the tube-shaped channel by the activated sealing fluid may be obtained. This may be advantageous, for instance, if the position of the fractures or leaks to be sealed is not easily detectable or if there are several fractures or leaks to be sealed along the tube-shaped channel.

Preferably, at least the second annular flow barrier scrapes against the wall or formation surrounding the tube-shaped channel during ejection of sealing fluid. Thereby, it may be possible to even better separate ejection of sealing fluid from curing of the same, although both ejection and curing may be carried out continuously.

In an embodiment, a section of the tube-shaped channel is treated two or more times by a sequence including sealing fluid ejection and subsequent sealing fluid activation. Thereby, for instance large fractures to be sealed, or the annular space on the outer side of a perforated tubing in a borehole, may be filled in steps, thereby building up a seal in a stepwise manner and avoiding excessive quantities of sealing fluid flowing away before it has been cured.

Preferably, in between or before said sequences, the tube-shaped channel is flushed by means of a fluid suitable to remove loose solid parts, such as an injection fluid or formation fluid produced from a reservoir. Thereby, non-consolidated solids that may prevent correct placement of the sealing fluid may be removed and therefore, repeated sequences may seal remaining openings of the fractures or leaks to be sealed.

Preferably, before the first of said sequences, the tube-shaped channel is pre-flushed with solvents, such as, for instance, toluene and xylene. Thereby, for instance in the case that the tube-shaped channel is formed in a rock, the rock surface may suitably be prepared for the sealing fluid.

In an embodiment, after or during ejection of sealing fluid from the sealing fluid placement section, a test pressure is measured in the tube-shaped channel in the annulus of the sealing device at the sealing fluid placement section between the first and second annular flow barrier, said test pressure is compared with a reference pressure, and subsequent activation by means of the sealing fluid activation section of the sealing fluid that has been ejected by the sealing fluid placement section is not performed before measurement of a test pressure that is higher than the reference pressure. Thereby, it may be avoided that sealing fluid starts curing before it has been ensured that sufficient sealing fluid pressure has been applied and thereby that fractures or leaks have been sufficiently deeply penetrated by sealing fluid.

In an embodiment, after or during ejection of sealing fluid from the sealing fluid placement section, a first test pressure is measured in the tube-shaped channel in the annulus of the sealing device at the sealing fluid placement section between the first and second annular flow barrier and at least one second test pressure is measured outside the first and/or the second annular flow barrier, a difference between the first test pressure and the second test pressure is compared with a reference pressure differential, and subsequent activation by means of the sealing fluid activation section of the sealing fluid that has been ejected by the sealing fluid placement section is not performed before measurement of a test pressure difference that is higher than the reference pressure differential. Thereby, it may be even better avoided that sealing fluid starts curing before it has been ensured that the sealing fluid has been correctly placed and thereby that fractures or leaks have been sufficiently deeply penetrated by sealing fluid.

In an embodiment, an activation fluid or substance is embedded into, mixed with or contained by the sealing fluid as the sealing fluid is ejected by the sealing fluid placement section, whereby the activation fluid or substance is released for contact with the sealing fluid by activation of the sealing fluid activation device, whereby, preferably, before activation, particles having a protective outer layer or coating enclosing the activation fluid or substance are provided, whereby, preferably, before activation, particles having a protective outer layer or coating enclosing the sealing fluid are provided, and whereby, preferably, said protective outer layer or coating is disintegrated by means of the sealing fluid activation device, preferably by the action of thermal radiation (heat), other radiation or solvent dissolution or substance provided by the sealing fluid activation device.

The present invention further relates to a method as described above for sealing fractures or leaks in a wall or formation surrounding a tube-shaped channel by means of a sealing device as described above.

BRIEF DESCRIPTION OF THE SEVERAL VIEWS OF THE DRAWING(S)

Figure 2:
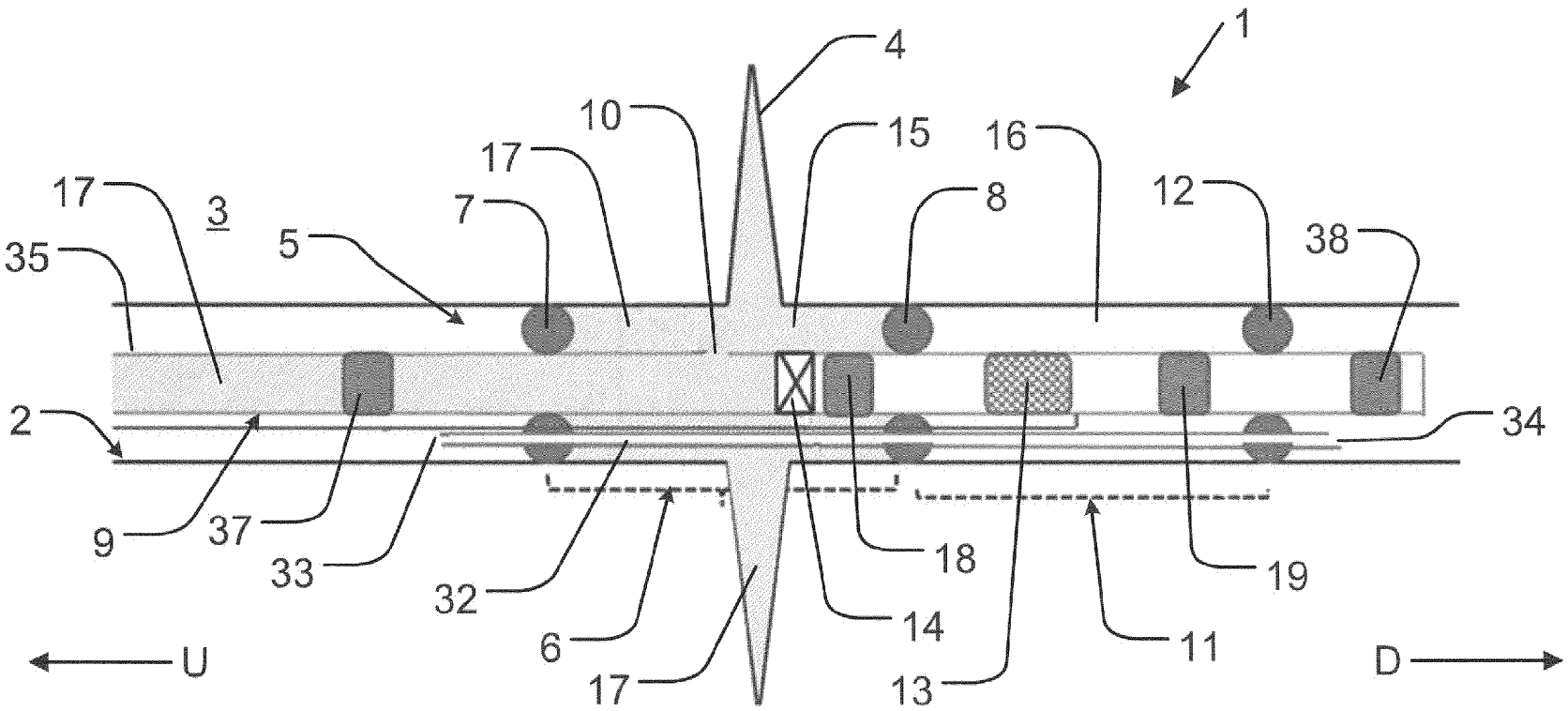
Figure 3:
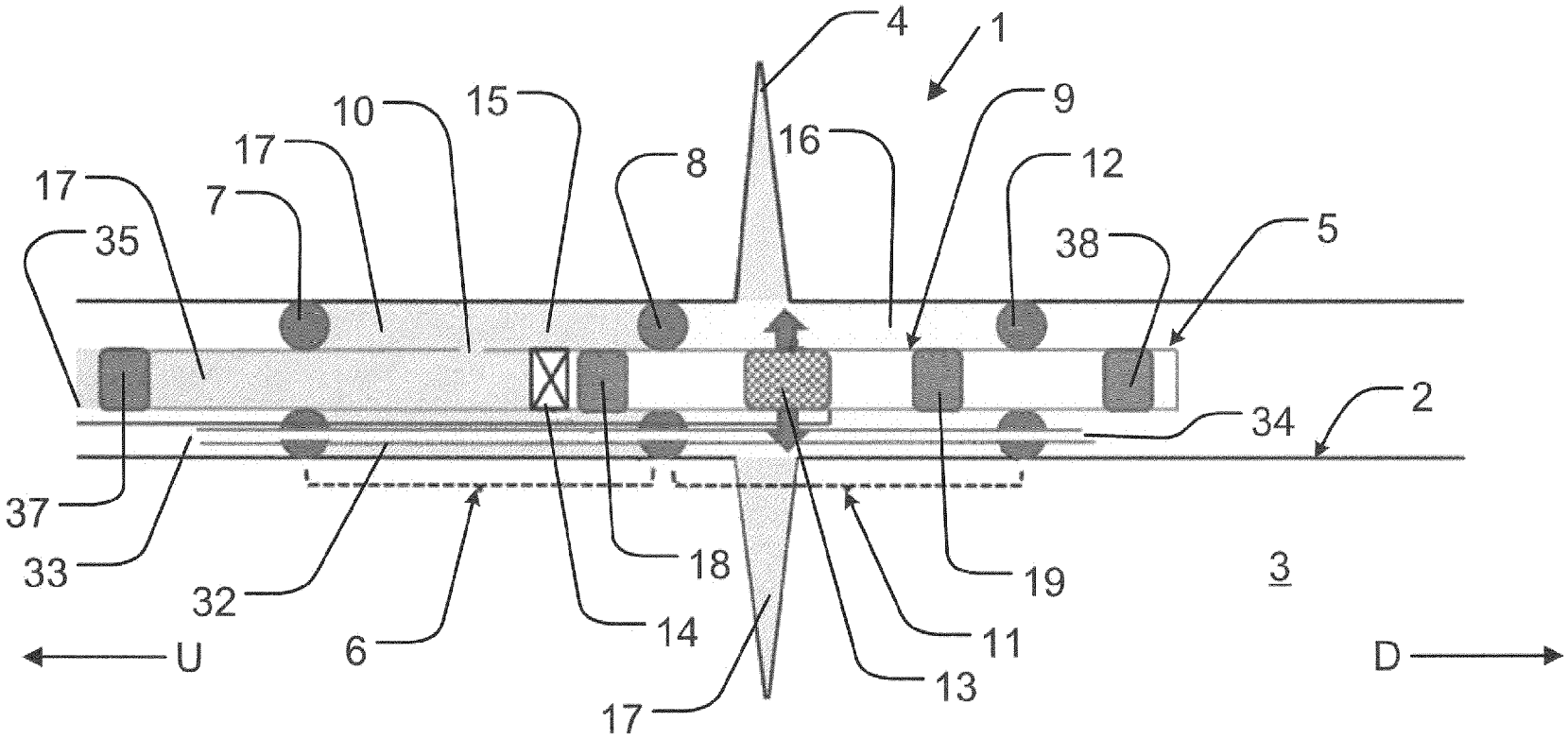
Figure 10:
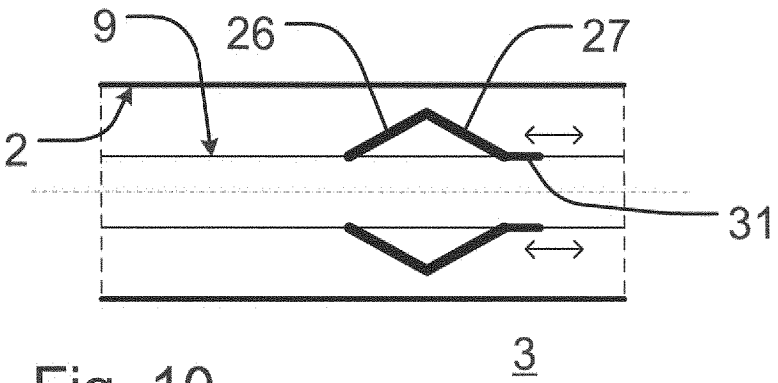
Figure 9:
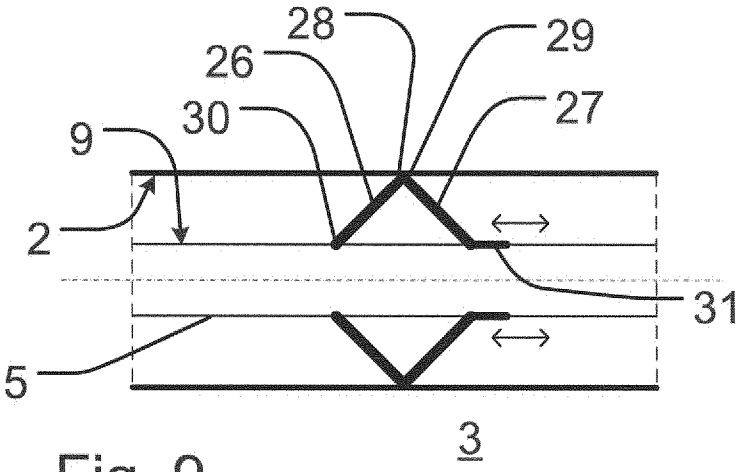
Figure 11:
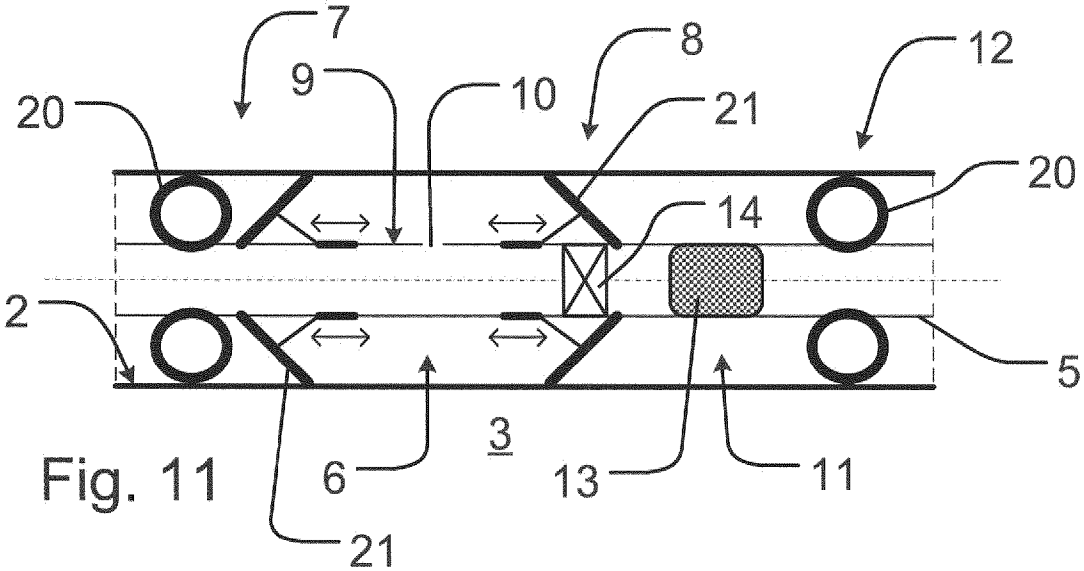

The invention will now be explained in more detail below by means of examples of embodiments with reference to the very schematic drawing, in which FIG. 1 illustrates a cross-section through a well bore, during positioning of a sealing device, FIG. 2 is an illustration corresponding to FIG. 1, during placement of sealing fluid, FIG. 3 is an illustration corresponding to FIG. 1, during activation of the sealing fluid, FIGS. 4 to 6 illustrate an embodiment of an expandable seal for the sealing device, at different states of expansion, FIGS. 7 and 8 illustrate another embodiment of an expandable seal for the sealing device, at different states of expansion, FIGS. 9 and 10 illustrate yet another embodiment of an expandable seal for the sealing device, at different states of expansion, and FIG. 11 illustrates a sealing device including different types of expandable seals.

DETAILED DESCRIPTION OF THE INVENTION

FIG. 1 shows a sealing device 1 that has been introduced into a tube-shaped channel 2 in the form of a well bore in a formation 3. The formation 3 surrounding the tube-shaped channel 2 has a fracture 4 that has to be sealed. In FIGS. 1 to 3, the uphole direction is indicated by the arrow U and the downhole direction is indicated by the arrow D.

Although the sealing device 1 is illustrated in the figures employed for the sealing of the fracture 4 (such as a fracture network or high permeability streaks) in the formation 3 surrounding an open hole well bore, it is just as well suitable for the sealing of any kind of fractures or leaks in a wall or formation surrounding a tube-shaped channel, such as holes in the wall of a sewer or drain pipe, in the wall of any kind of pipeline or in the wall of a casing inserted into a well bore, whether the casing is perforated and/or cemented.

The sealing device 1 includes an elongated body 5 illustrated as a tube and having a longitudinal direction extending in the axial direction of said tube. The elongated body 5 includes a sealing fluid placement section 6 arranged between a first annular flow barrier 7 and a second annular flow barrier 8. The sealing fluid placement section 6 includes a sealing fluid outlet port 10 through which sealing fluid 17 may be injected from inside the elongated body 5 to the tube-shaped channel. The elongated body 5 furthermore includes a sealing fluid activation section 11 arranged between the second annular flow barrier 8 and a third annular flow barrier 12. Each of the first, second and third annular flow barriers 7, 8, 12 extends from a circumference 9 of the elongated body 5 to the formation 3 surrounding the tube-shaped channel 2. The sealing fluid activation section 11 includes a sealing fluid activation device 13 adapted to at least initiate or accelerate curing of the sealing fluid 17.

The sealing fluid outlet port 10 of the sealing fluid placement section 6 may simply have the form of a single opening or valve opening adapted to eject sealing fluid 17 from the inside of the elongated body 5. However, it may also have the form of several openings positioned suitably at the circumference of the elongated body 5 in order to improve distribution of the sealing fluid. Depending on the viscosity and/or nature of the sealing fluid 17, the sealing fluid outlet port 10 may include spray heads, blowers or any other devices suitable for the placement of the sealing fluid 17. Although the sealing fluid 17 is described as a fluid, it is noted that also a powder, possibly in fluidised form, may act as sealing fluid 17. Such powder may be ejected by means of a spray head, a blower or any other suitable device.

Although the sealing fluid placement section 6 and the sealing fluid activation section 11 are illustrated in the figures as being placed next to each other, these sections may also be spaced apart. This may for instance be the case, if the sealing fluid activation device 13 is positioned relatively far from the second annular flow barrier 8 and relatively near the third annular flow barrier 12, so that the sealing fluid placement section 6 is spaced apart from the second annular flow barrier 8. In another embodiment, the second annular flow barrier 8 may be composed by two spaced apart flow barriers, such as two separate expandable seals that are spaced in relation to each other, but together form the second annular flow barrier 8, thereby providing a space between the sealing fluid placement section 6 and the sealing fluid activation section 11.

The first, second and third annular flow barriers 7, 8, 12 are adapted to, depending on the operative situation, at least partly seal the respective circumference of the elongated body 5 against the wall or formation 3 surrounding the tube-shaped channel 2.

In a preferred embodiment, the sealing fluid activa-tion device 13 includes a neutron accelerator (such as the logging tool MINITRON®) adapted to cause secondary gamma radiation in the wall or formation surrounding the tube-shaped channel. The secondary gamma radiation may at least initiate or accelerate curing of a sealing fluid 17. However, according to the invention, the sealing fluid activation device 13 may operate by means of radiation in general, for instance thermal radiation, depending on the sealing fluid 17 to be employed. Furthermore, according to the invention, the sealing fluid activation device 13 may include an outlet opening for an activation fluid, whereby a sealing fluid already ejected may be activated by subsequent ejection of said activation fluid. Preferably, said activation fluid may be ejected at a relatively elevated ejection pressure, preferably higher than the ejection pressure of the sealing fluid, in order to ensure that the sealing fluid is in fact cured sufficiently deep into the fractures or leaks to be sealed.

Furthermore, according to the invention, the sealing fluid activation device 13 may be adapted to activate the sealing fluid 17 by providing an electric current through the sealing fluid subsequent to placement of the sealing fluid. This may for instance be obtained by providing the sealing fluid activation device 13 with an outlet opening for an activation fluid in the form of an electrically conducting fluid, whereby a sealing fluid already ejected may be activated by subsequent ejection of said electrically conducting fluid and the provision of the sealing fluid activation device 13 with an electrically conductive electrode. Instead of providing said electrically conducting fluid, the sealing fluid activation device 13 may be provided with an electrically conductive electrode, possibly extending from the elongated body 5, adapted to contact the sealing fluid already ejected. In order to provide an electric current through the sealing fluid, a further electrically conducting electrode may be provided elsewhere, for instance as an earth rod inserted into the formation 3, for instance at the surface of the formation 3, and thereby providing an electrical connection to the formation 3.

Furthermore, according to the invention, the sealing fluid activation device 13 may be adapted to activate the sealing fluid 17 by providing an elevated pressure, possibly in the form of a pressure burst, in the already ejected sealing fluid 17. This may be possible, for instance, if the sealing fluid 17 and the activation fluid have been separated from each other by providing at least one of these in separate particles having a protective outer layer or coating, as discussed in more detail below. The elevated pressure may be able to break or disintegrate said protective outer layer or coating, thereby bringing the sealing fluid 17 and the activation fluid in contact with each other.

In the embodiments according to which the sealing fluid activation device 13 may operate by means of radiation, a plug 14 or seal adapted to shield against radiation is positioned in the elongated body 5 of the sealing device 1 in an area at the transition between the sealing fluid placement section 6 and the sealing fluid activation section 11 as illustrated in FIGS. 1 to 3. Ideally, the plug 14 or seal could be placed right at the second annular flow barrier 8 in order to ensure that the sealing fluid 17 in the sealing fluid placement section 6 is not cured by the radiation emitted by the sealing fluid activation device 13. However, in practice, as illustrated in the figures, the plug 14 may be positioned slightly displaced in relation to the second annular flow barrier 8, for instance to give place to equipment auxiliary to the second annular flow barrier 8.

According to the invention, as illustrated in the FIGS. 1 to 3, generally, the sealing device 1 is operated as follows: The elongated body 5 is firstly introduced into the tube-shaped channel 2 and the sealing fluid placement section 6 is positioned at a position along the tube-shaped channel where sealing is to be performed, as illustrated in FIG. 1. Then sealing fluid 17 is ejected from the sealing fluid placement section 6 through the sealing fluid outlet port 10 into an annular volume 15 present between the elongated body 5 and the tube-shaped channel 2 inside the sealing fluid placement section 6, as illustrated in FIG. 2. From there, the sealing fluid 17 will flow into any fractures or leaks present in the section of the tube-shaped channel 2 isolated between the first and second annular flow barriers 7, 8 as illustrated by the fracture 4 in the figures. Subsequently, the elongated body 5 is displaced along the tube-shaped channel 2 until the sealing fluid activation section 11 of the elongated body is placed at a position where sealing fluid 17 has been ejected by the sealing fluid placement section 6, and the sealing fluid activation device 13 of the sealing fluid activation section 11 is activated, whereby curing of the already ejected sealing fluid is at least initiated or accelerated, as illustrated in FIG. 3. As it is visible in the figure, in this position of the sealing fluid activation section 11, the annular volume 16 present between the elongated body 5 and the tube-shaped channel 2 inside the sealing fluid activation section 11 may be emptied or at least practically or almost emptied of sealing fluid 17, so that only or almost only the fractures 4 or leaks to be sealed are filled with sealing fluid 17 at this position. Depending on the sealing effect of the second annular flow barrier 8, a suitably thin layer of sealing fluid 17 may be left on the surface of the tube-shaped channel 2; thereby, in effect, coating said channel.

Fractures to be sealed may be located preliminarily by logging. The fracture or fracture connection may somehow be characterized in terms of geometry, volume and conductivity. Relevant information from tracer studies, production tests and interference tests may be utilized.

The sealing fluid 17 may be supplied to the elongated body 5 through a tubing 35 running into the tube-shaped channel 2, for instance. In this case, a certain amount of sealing fluid 17 may initially be filled into the tubing 35, and subsequently, a so-called displacement fluid, preferably a highly viscous fluid, may be filled into the tubing 35 behind the sealing fluid 17 in order to drive the latter into the sealing device 17 without spending too much sealing fluid 17 for the sealing operation. Furthermore, water may be filled into the tubing 35 behind, that is following, said displacement fluid. The ejection of sealing fluid 17 through the sealing fluid outlet port 10 may be controlled by means of a not shown valve or valves or by means of a so-called burst disc that may break when a certain pressure is applied. The sealing fluid 17 may also be stored in a container of the sealing device 1.

The sealing device 1 may be introduced into the tube-shaped channel 2 by means of the tubing 35 mentioned above, for instance by assembling the tubing 35 from a number of subsequent sections or by introducing the tubing 35 in the form of a so-called coiled tubing, as is well known from the oil industry. Furthermore, the sealing device 1 may be introduced into the tube-shaped channel 2 as a self-propelled drone or tractor, or the sealing device 1 may have the form of a drone that is pumped into the tube-shaped channel 2. In the case of a drone or tractor, it may be preferred to store the sealing fluid 17 in a container on board the sealing device 1; however, it may also be supplied via a tubing 35.

It may be preferred that curing of the ejected sealing fluid is not even initiated before the sealing fluid activation section 11 has been placed at the position where the sealing fluid 17 was ejected. This may be obtained, firstly, by choosing a sealing fluid that does not cure before activated by the sealing fluid activation section, and secondly, by ensuring that the sealing fluid placement section 6 is properly separated from the sealing fluid activation section 11. The latter may be obtained if the second annular flow barrier 8 is suitably sealing, and, in the case that the sealing fluid activation section 11 operates by means of radiation, if a plug 14 or seal adapted to shield against radiation is suitably positioned as mentioned above. Thereby, it is possible to initiate or start curing of the sealing fluid 17 only when the sealing fluid has penetrated the fractures or leaks to be sealed. Therefore, the flow of the sealing fluid into the fractures or leaks may be facilitated as an initial low viscosity of the sealing fluid may be preserved until curing is initiated or started by means of the sealing fluid activation section 11. Furthermore, surplus sealing fluid may easier be scraped away from the wall or formation 3 surrounding the tube-shaped channel 2 by means of the second annular flow barrier 8, and it may even better be avoided that the sealing device 1 is stuck in the tube-shaped channel 2 due to curing of surplus sealing fluid 17 present in the annular volume 15 in the sealing fluid placement section 6 or due to curing of sealing fluid leaking from the sealing fluid placement section 6 over the first and second annular flow barriers 7, 8.

It may be preferred that curing of the ejected sealing fluid 17 is at least almost finished before the sealing fluid activation section 11 is removed in order to even better avoid that cross flow in the tube-shaped channel 2 washes away the sealing fluid 17 before it has been cured.

According to an embodiment of the method for sealing fractures or leaks according the invention (denoted the stepwise method), the elongated body 5 is displaced along the tube-shaped channel 2 in a stepwise manner in such a way that in a first step (corresponding to FIGS. 1 and 2), the elongated body is displaced to a certain position along the tube-shaped channel 2 and arrested there during ejection of sealing fluid 17 into the tube-shaped channel 2, and in a second step (corresponding to FIG. 3), the elongated body is displaced to another position along the tube-shaped channel and arrested there during activation by means of the sealing fluid activation section 11 of the sealing fluid 17 that has been ejected by the sealing fluid placement section 6, and these two steps are repeated several times in order to seal fractures 4 or leaks at different positions of the tube-shaped channel. An advantage of this embodiment may be that the first, second and third annular flow barriers 7, 8, 12 may be operated to seal very effectively against the tube-shaped channel 2 during placement of sealing fluid 17, as the elongated body 5 is arrested so that no relative motion occurs between the flow barriers 7, 8, 12 and the tube-shaped channel. Therefore, the flow barriers 7, 8, 12 may, for instance, take the form of expandable seals and an elevated expansion force may be applied to these. Thereby, it may be effectively ensured that sealing fluid 17 does not escape from the sealing fluid placement section 6 during ejection of sealing fluid. Furthermore, placement of the sealing fluid may be surveilled, for instance by means of pressure measurements, and on the basis thereof controlled to a large extent before curing is even initiated so that curing of sealing fluid that has not been correctly placed may effectively be avoided by delaying or omitting said second step of the method. Furthermore, as a result, it may be particularly effectively prevented that cross flow in the tube-shaped channel 2 washes away the sealing fluid 17 before it has cured.

According to another embodiment of the method for sealing fractures or leaks according the invention (denoted the continuous method), the elongated body 5 is displaced along the tube-shaped channel 2 in a continuous manner during ejection of sealing fluid 17 into the tube-shaped channel 2 by means of the sealing fluid placement section 6 and during simultaneous activation by means of the sealing fluid activation section 11 of sealing fluid 17 previously ejected by the sealing fluid placement section 6. Thereby, a whole section of the tube-shaped channel 2 may so to say be lined by the activated sealing fluid. This may be advantageous, for instance, if the position of the fractures or leaks to be sealed is not easily detectable or if there are several fractures or leaks to be sealed along the tube-shaped channel. Furthermore, such a lining may be attractive in the case that a pipe system is simply in a general bad structural state and otherwise would need to be replaced by a new pipe system. The lining may support such weak pipe structure and therefore prevent that the pipe system breaks down at a later state. This may for instance be the case in a sewer system. As the sealing fluid placement section 6 and the sealing fluid activation section 11 by means of the first and third annular flow barriers 7, 12 may be isolated from the remaining part of the tube-shaped channel during lining of the same with sealing fluid, a method of lining a tube-shaped channel without having to empty said channel of liquids, such as drilling mud or sewage or even without having to terminate normal operation of said channel is thereby provided. In general, unintentional impairment of the remaining part of said channel may thereby be avoided. According to this embodiment, preferably, at least the second annular flow barrier 8 scrapes against the wall or formation surrounding the tube-shaped channel 2 during ejection of sealing fluid in order to suitably separate ejection of sealing fluid 17 from curing of the same, when both ejection and curing are carried out continuously. If a distinct lining of the tube-shaped channel 2 by means of sealing fluid is required or desired, the force by means of which the second annular flow barrier 8 presses against the wall or formation may be adjusted accordingly in order to obtain the desired thickness of said lining. If a relatively thick lining is required, of course, the second annular flow barrier 8 may not be in direct contact with the wall or formation, but may slide at a suitable distance therefrom, thereby providing the required space for the sealing fluid to form said lining on the wall or formation 3.

Whether the sealing device 1 is operated according to the above described stepwise or continuous method, after or during ejection of sealing fluid 17 from the sealing fluid placement section 6, a test pressure may be measured in the tube-shaped channel 2 at the sealing fluid placement section by means of a temperature gauge 18 placed between the first and second annular flow barriers 7, 8. Said test pressure may be compared with a reference pressure, and subsequent activation by means of the sealing fluid activation section 11 of the sealing fluid 17 that has been ejected by the sealing fluid placement section 6 may then be avoided until a test pressure that is higher than the reference pressure has been measured. During stepwise operation, this may result in that the ejection operation is repeated until the required test pressure is measured. During continuous operation, this may for instance result in that the continuous displacement of the sealing device 1 is stopped immediately and ejection is continued until the required test pressure is measured. Another possibility is that the ejection pressure is elevated until the required test pressure is measured. Subsequently, the continuous operation may be resumed. By the measurement of a test pressure, it may be avoided that sealing fluid starts curing before it has been ensured that sufficient sealing fluid pressure has been applied and thereby that fractures or leaks have been sufficiently deeply penetrated by sealing fluid.

The pressure gauge 18 may be combined with a temperature gauge. Furthermore, the sealing device 1 may be provided with several other pressure/temperature gauges 19, 37, 38 at suitable positions as illustrated in the figures in order to surveil the operation of the device in a suitable manner. The skilled person will understand that other pressure/temperature gauges may be provided at many other suitable positions according to requirements. It is noted that although the pressure/temperature gauges 18, 19, 37, 38 are illustrated as being located inside the elongated body 5, these may be located partly or entirely outside the elongated body 5. In any case, the pressures/temperatures measured by the pressure/temperature gauges 18, 19, 37, 38 are preferably the pressures/temperatures in the annular volume present between the elongated body 5 and the tube-shaped channel 2. In practice, the measurement of a single test pressure as mentioned by way of simple example above, may not be sufficient, and therefore the operation of the sealing device 1 may suitably be surveilled by means of two or more of the several pressure and temperature gauges 18, 19, 37, 38, preferably on a stepwise or continuous basis. The values resulting from the measurements performed may then be compared with values expected on the basis of detailed analyses of the situation and theoretic models representing the situation, and the required action may be decided on the basis thereof.

For instance, the pressure/temperature gauge 37 is arranged outside the first annular flow barrier 7 in relation to the sealing fluid placement section 6, in other words, in the embodiment illustrated in FIGS. 1 to 3, this means that the pressure/temperature gauge 37 is positioned above or in uphole direction of the first annular flow barrier 7. Thereby, for instance by measuring a pressure difference occuring between the the pressure/temperature gauge 37 above the first annular flow barrier 7 and the pressure/temperature gauge 18 inside the fluid placement section 6, which is below or in downhole direction of the first annular flow barrier 7, the tightness of the first annular flow barrier 7 may be tested. Similarly, the pressure/temperature gauge 38 is arranged outside the third annular flow barrier 12 in relation to the sealing fluid activation section 11, in other words, in the embodiment illustrated in FIGS. 1 to 3, this means that the pressure/temperature gauge 38 is positioned below or in downhole direction of the third annular flow barrier 12. Thereby, for instance, by means of the pressure/temperature gauge 19 and the the pressure/temperature gauge 38 the tightness of the third annular flow barrier 12 may be tested. Similarly, for instance, by means of the pressure/temperature gauge 18 and the pressure/temperature gauge 19 the tightness of the second annular flow barrier 8 may be tested. In is noted that in addition to pressure measurements, temperature measurements alone or in combination with pressure measurements may give a good indication of flow directions in the tube-shaped channel 2, for instance whether flow is directed in uphole or downhole direction across an annular flow barrier.

Whether the sealing device 1 is operated according to the above described stepwise or continuous method, a section of the tube-shaped channel 2 may be treated two or more times by a sequence including sealing fluid ejection and subsequent sealing fluid activation, whereby, preferably, in between or before said sequences, the tube-shaped channel 2 may be flushed by means of a fluid suitable to remove loose solid parts. Thereby, loose solid parts that may prevent correct placement of the sealing fluid may be removed and therefore, repeated sequences may seal remaining openings of the fractures or leaks to be sealed. Preferably, before the first of said sequences, the tube-shaped channel is pre-flushed with solvents, such as, for instance, toluene and xylene. Thereby, for instance in the case that the tube-shaped channel is formed in a rock, the rock surface may suitably be prepared for the sealing fluid.

FIGS. 4 to 6 illustrate an embodiment of an annular flow barrier including an expandable seal 20 in the form of a hollow elastic ring adapted to be inflated by an inflation fluid. The inflation fluid may include liquid, gas and any combination thereof. The expandable seal 20 is adapted to be transformable between a first, retracted configuration illustrated in FIG. 4, a second expanded configuration illustrated in FIG. 5, and a third expanded configuration illustrated in FIG. 6. As it may be seen, in both the second and third expanded configurations, the expandable seal 20 extends further away from the circumference 9 of the elongated body 5 than it does in the retracted configuration. However, the sealing device 1 is adapted to apply a greater expansion force to the expandable seal 20 in the third expanded configuration than in the second expanded configuration so that a greater sealing force may be obtained.

The annular flow barrier including the expandable seal 20 illustrated in FIGS. 4 to 6 may be operated in the following way: During introduction of the elongated body 5 into the tube-shaped channel 2 and during displacement of the elongated body until the sealing fluid placement section 6 of the elongated body is placed at a position where sealing fluid 17 is to be ejected, the pressure of the inflation fluid is maintained below a first inflation pressure so that the expandable seal adopts the first, retracted configuration illustrated in FIG. 4. Subsequently to ejecting the sealing fluid 17 into the tube-shaped channel 2, during displacement of the elongated body 5 along the tube-shaped channel 2 until the sealing fluid activation section 11 of the elongated body is placed at a position where sealing fluid has been ejected by the sealing fluid placement section 6, the pressure of the inflation fluid is maintained above a second inflation pressure greater than the first inflation pressure so that the expandable seal 20 adopts the second expanded configuration illustrated in FIG. 5 so that the expandable seal 20 scrapes along the wall or formation 3 surrounding the tube-shaped channel 2. At least during ejection of the sealing fluid 17, the pressure of the inflation fluid is maintained above a third inflation pressure greater than the second inflation pressure so that the expandable seal 20 adopts the third expanded configuration illustrated in FIG. 6 in which the expandable seal 20 seals a circumference 9 of the elongated body 5 against the wall or formation 3 surrounding the tube-shaped channel 2 to a greater extent than when the expandable seal 20 adopts the second expanded configuration. In fact, it may be so that the sealing fluid outlet port 10 should be opened for injection of sealing fluid 17 only when the pressure of the inflation fluid is already above the third inflation pressure, as otherwise it may be difficult to fully expand the expandable seal 20.

The expandable seal 20 illustrated in FIGS. 4 to 6 in the form of a hollow elastic ring may just as well have any other suitable configuration enabling it to be expanded, for instance by means of inflation by an inflation fluid or by any other suitable means. Examples of such expandable seals may include a not shown membrane covering an annular groove extending around the circumference 9 of the elongated body 5, whereby the membrane may be expanded by inflating said annular groove with an inflation fluid, or a not shown elastic ring embedded in such annular groove and likewise expandable by inflating said annular groove or expandable by displacement of wedges distributed around the inside said annular groove in the longitudinal direction of the elongated body 5. The expandable seal 20 may be operable by different means and may for instance be electrically activatable. In the case of the displaceable wedges as just mentioned, these may be displaced by means of an electric motor. In the case of inflatable seals, these may be inflated by means of a fluid pump or by means of a pressurised fluid that is supplied through en electrically activatable valve, such as a solenoid valve. It will be understood by the skilled person that many other possibilities exist.

FIGS. 7 and 8 illustrate an embodiment of the sealing fluid placement section 6 arranged between the first and second annular flow barriers 7, 8. Each of the first and second annular flow barriers 7, 8 includes an expandable seal in the form of an elastic flange 21 extending out from a circumference 9 of the elongated body 5 and having a radially outer edge 22 adapted to scrape against the wall or formation 3 surrounding the tube-shaped channel 2. In the embodiment shown, seen in an axial section, the elastic flange 21 extends in an oblique direction in relation to the longitudinal direction of the elongated body 5 of the sealing device 1. The elastic flanges 21 may function like a one-way valve, whereby an under pressure inside the sealing fluid placement section 6 may result in that the elastic flanges 21 bend slightly and opens for flow, and whereby an over pressure inside the sealing fluid placement section 6 may result in that the elastic flanges 21 are forced even more against the wall or formation 3 surrounding the tube-shaped channel 2 and therefore seals even better. Apart from being elastic bendable, the elastic flanges 21 may also be hinged about an annular axis 23 in order to tilt between an expanded position as illustrated in FIG. 7 and a retracted position as illustrated in FIG. 8.

In the embodiment shown, the radially outer edge 22 of the elastic flange 21 is automatically adjustable between the retracted position and the expanded position by means of a slider 24 displaceable in the longitudinal direction of the elongated body 5 as illustrated by the arrow and connected to the elastic flange 21 by means of a hinge arm 25 tiltably connected to the slider 24 and tiltably connected to the elastic flange 21. The slider 24 may have the form of a fluid driven piston. Any other suitable arrangement for automatic adjustment of the elastic flanges 21 may be employed.

FIGS. 9 and 10 illustrate an embodiment of an annular flow barrier including two elastic flanges 26, 27 each extending out from the circumference 9 of the elongated body 5 in an oblique direction in relation to the longitudinal direction of the elongated body of the sealing device 1. The two elastic flanges 26, 27 have radially outer edges 28, 29 positioned against and connected to each other so that the two elastic flanges are reversed in relation to each other, and said radially outer edges of the two elastic flanges are adapted to scrape against the wall or formation 3 surrounding the tube-shaped channel 2. The first elastic flange 26 is arranged tiltably about an annular axis 30, but fixed longitudinally in relation to the elongated body 5. The second elastic flange 27 is automatically adjustable between the retracted position and the expanded position together with the first elastic flange 26 by means of a slider 31 displaceable in the longitudinal direction of the elongated body 5 as illustrated by the arrow.

FIG. 11 illustrates one of several possible configurations of the sealing device 1 according to the invention having a sealing fluid placement section 6 and a sealing fluid activation section 11. The first annular flow barrier 7 includes an expandable seal 20 in the form of a hollow elastic ring as illustrated in FIGS. 4 to 6 and an expandable seal in the form of an elastic flange 21 as illustrated in FIGS. 7 and 8. The second annular flow barrier 8 includes an elastic flange 21 as illustrated in FIGS. 7 and 8; however, arranged in mirrored configuration in relation to the elastic flange 21 included by the first annular flow barrier 7. The third annular flow barrier 12 includes an expandable seal 20 in the form of a hollow elastic ring as illustrated in FIGS. 4 to 6. The configuration illustrated in FIG. 11 may have an advantage in that sealing fluid ejected inside the sealing fluid placement section 6 may be particularly well scraped off the tube-shaped channel 2 by means of the elastic flanges 21 during displacement of the elongated body 5 in the tube-shaped channel 2. Furthermore, when the elongated body 5 is arrested in the tube-shaped channel 2, by means of the expandable seals 20 in the form of hollow elastic rings it may suitably be avoided that cross flow in the tube-shaped channel 2 washes away the sealing fluid 17 before it has been cured or in any other way disturbs the sealing operation.

Any one of the first, second and third annular flow barriers 7, 8, 12 of the sealing device 1 illustrated in FIGS. 1 to 3 may include any suitable combination of expandable and/or elastic seals as described or suggested above or as illustrated in FIGS. 4 to 11. Furthermore, one of the first, second and third annular flow barriers 7, 8, 12 may take the form of or include devices such as so-called swap cups or any kind of inflatable or swellable packer systems for instance in the form of so-called straddle packers, such as the packers available from the company TAM.

In particular, as mentioned above, the second annular flow barrier 8 may include two seals spaced apart in order to provide a space between the sealing fluid placement section 6 and the sealing fluid activation section 11. This could, for instance in the case that the sealing fluid activation device 13 may operate by means of radiation, be an advantage in that it could even better be ensured that the sealing fluid 17 present in the sealing fluid placement section 6 is not cured by the radiation emitted by the sealing fluid activation device 13.

As illustrated in FIGS. 1 to 3, the elongated body 5 of the sealing device 1 may include a cross flow shunt tube 32 having a first end opening 33 positioned outside the first annular flow barrier 7 in relation to the sealing fluid placement section 6 and a second end opening 34 positioned outside the third annular flow barrier 12 in relation to the sealing fluid activation section 11. Thereby, it may be avoided that cross flow in the tube-shaped channel substantially affects the sealing operation.

The sealing device 1 according to the invention may include a recirculation port 36 that may be positioned outside the part of the elongated body isolated by the first and third annular flow barriers 7, 12, preferably as illustrated in FIG. 1, above or in uphole direction of the first annular flow barrier 7. The recirculation port 36 is adapted for recirculation of fluids including sealing fluid through the part of the tube-shaped channel 2 extending from the sealing device 1 to the surface of the formation 3. Thereby, for instance, the above-discussed tubing 35 for the supply of sealing fluid 17 running into the tube-shaped channel 2 may be drained from drilling mud or the like before injecting the sealing fluid so that it may be avoided that said drilling mud or the like is injected into the fractures or leaks to be sealed. Furthermore, a section of the tube-shaped channel may be treated two or more times by a sequence including sealing fluid ejection and subsequent sealing fluid activation, whereby in between or before said sequences, the tube-shaped channel may be flushed by means of a fluid suitable to remove loose solid parts.

The sealing device 1 according to the invention may be utilized with a wide range of different types of sealing fluid 17 and with a wide range of different types of sealing fluid activation device 13. As mentioned above, the sealing fluid 17 may be adapted to be activated by means of any suitable kind of radiation, such as thermal radiation, electromagnetic radiation, such as UV-radiation, X-rays, or gamma-rays, or radioactive or particle radiation or by means of an activation fluid including any suitable combination of liquid and/or gas. By activation of the sealing fluid 17 is to be understood that a curing of the sealing fluid is at least initiated, started or speeded up. Therefore, depending on the type of sealing fluid 17 applied and on the type of sealing fluid activation device 13 utilized, the radiation or the activation fluid may either be necessary to start the curing so that the curing will continue after activation also when the radiation or the supply of activation fluid has stopped, or the radiation or the activation fluid may have to be present during the entire curing time in order to maintain the curing process. The curing of the sealing fluid 17 may start already when the sealing fluid is ejected by the sealing fluid placement section 6; however, in this case, it is preferred that substantial curing does not start before activation by means of the sealing fluid activation section 11 or at least that the activation causes a significant acceleration of the curing process. Thereby, as explained above, it may be ensured that the sealing fluid does not thicken before it has reached sufficiently deep into the fractures or leaks to be sealed. It may be preferred that the activation is necessary only to start the curing, because in this case the sealing device 1 may be displaced and employed for sealing at a second position before curing of sealing fluid at a first position has been completed. Thereby, more efficient use may be made of the sealing device 1.

In the case that the sealing fluid activation device 13 is adapted to function by radiation, the activation may simply take the form of speeding up the process of curing. For instance, as it is well known, many chemical processes may be accelerated by heating.

However, in the case that the sealing fluid 17 may cure by contact with an activation fluid or other activation substance, it may be preferred that said activation fluid or substance is embedded into, mixed with or contained by the sealing fluid 17 as the sealing fluid is ejected by the sealing fluid placement section 6 in such a way that said activation fluid or substance may be released for contact with the sealing fluid 17 by activation of the sealing fluid activation device 13.

Before activation of the sealing fluid 17, the activation fluid or substance may be embedded into or contained by the sealing fluid 17 by providing, in the sealing fluid 17, particles having a protective outer layer or coating enclosing the activation fluid or substance. Thereby, activation of the sealing fluid 17 may be at least hindered or avoided until the protective outer layer has been fully or partly removed. Removal of the protective layer may take place by the action of heat (thermal radiation), other kinds of radiation, such as electromagnetic or particle radiation, or solvent dissolution provided by the sealing fluid activation device 13. In particular, removal of the protective layer may take place by the action of any combination of one or more of these means. For instance, a combination of thermal radiation and electromagnetic and/or particle radiation could be used in order to obtain a desired deep penetration into a formation and at the same time obtain a fast curing of the sealing fluid. Alternatively, the sealing fluid 17 may be provided as particles having a protective outer layer or coating enclosing the sealing fluid 17, and said particles may be provided in the activation fluid or substance. Furthermore the sealing fluid 17 may be contained in separate particles and the activation fluid or substance may be contained in separate particles and a mixture of these particles may be ejected by the sealing fluid placement section 6. The sealing fluid 17 may, of course, include auxiliary fluids or substances. Therefore, in this application, the term sealing fluid 17 is intended to denote also a mixture of sealing fluid and activation fluid or substance.

In the case that the sealing fluid 17 and/or the activation fluid or substance is provided in particles having a protective outer layer or coating, it may be preferred to vary the size of the particles according to the size and nature of the fractures or leaks to be sealed. For instance, if a fracture 4 having decreasing cross-section in the direction away from the tube-shaped channel 2, as illustrated in FIGS. 1 to 3, is to be filled with such particles having a protective outer layer or coating, possibly in combination with a base fluid, a first batch of particles having a relatively small size or diameter may initially be ejected into the fracture 4, and subsequently a second batch of particles having a relatively larger size or diameter may be ejected into the fracture 4. Thereby, the particles having a relatively small size or diameter may better reach the bottom of the fracture 4 having relatively small cross-section, and the particles having a relatively larger size or diameter may thereby easily fill up the part of the fracture 4 having a relatively larger cross-section. Naturally, even more batches having respective particles of increasing size may be introduced into the fracture 4. The different batches of particles having different size may be introduces into the sealing device 1 through the tubing 35, whereby the batches may be supplied after each other in the longitudinal length of the tubing 35, possibly divided by plugs of so-called displacement fluid as mentioned above. Alternatively, or in addition, the different batches of particles having different size may be stored in different containers of the sealing device 1.

Alternatively, in some cases a first batch of particles having a relatively large size or diameter may initially be ejected into the fracture 4 to obtain a back pressure from a partial fracture blockage in the cases where the relatively smaller particles do or are anticipated to just "disappear" into the formation. Subsequently, a second batch of particles having a relatively smaller size or diameter may be ejected into the fracture 4 in order to finally seal the fracture appropriately. In general, staging of individual batches/slugs of sealing fluid having different particle size distribution may depend on parameters like reservoir properties and geometry of well and fractures to be sealed.

One example of a suitable sealing fluid 17 includes:

a) possibly a base fluid;

b) an elastomeric material comprising at least one polymer capable of cross linking into an elastomer, and c) at least one cross linking agent, wherein the elastomeric material and/or the at least one cross linking agent is provided as particles comprising an outer layer of a first thermoplastic material.

Optionally, the sealing fluid 17 may comprise a filler, for instance in the form of sand, grit, glass fibres, stone fibres or any other suitable material that may strengthen the material.

Alternatively, the sealing fluid 17 may simply include the above-mentioned components a) and b) and the component c) may be supplied by the activation section 11 in the way discussed above.

Such sealing fluid and associated cross linking agent is disclosed in more detail in the Applicants' copending patent application of same date, titled "A method of providing a barrier in a fracture-containing system", EP No. 2925830.

Another example of a suitable sealing fluid 17 may be configured as follows:

A cement composition including a hydraulic cement and a sufficient amount of water to form a slurry, whereby a desired amount of an accelerator or oxidizing agent is added to the slurry. Furthermore, a retarder may be added. The slurry may be subjected to ionizing radiation after placement of the slurry into the tube-shaped channel 2. The accelerator or oxidizing agent is combined with a polymeric component serving to prevent the release of the accelerator or oxidizing agent into the cement slurry. Ionizing radiation introduced may dissolve, degrade, or otherwise break down, the polymeric component thus allowing the accelerator or oxidizing agent to be released into the cement slurry. Once the accelerator or oxidizing agent is released, it may be dispersed into the cement slurry and react with the slurry or the retarder, resulting in the initiation of the curing or setting process.

Yet another example of a suitable sealing fluid 17 may be configured as follows:

In a first embodiment, the sealing fluid 17 forms a first component of a two-part epoxy, and an activation fluid forms a second component of said two-part epoxy. The activation fluid may be ejected by the sealing fluid activation section 11 in order to start curing of the epoxy. Furthermore, the sealing fluid activation section 11 may include a heater in order to accelerate curing of a resulting thermosetting polymer.

In a second embodiment, the sealing fluid 17 may include particles having a protective outer layer or coating enclosing a first component of a two-part epoxy and/or particles having a protective outer layer or coating enclosing a second component of said two-part epoxy. Thereby, said first and second components may be separated during placement of the sealing fluid 17. Removal of the protective layer may take place as described above by means of the sealing fluid activation device 13. Furthermore, the sealing fluid activation section 11 may include a heater in order to accelerate curing of a resulting thermosetting polymer.

Optionally, the sealing fluid 17 may comprise a filler, for instance in the form of sand, grit, glass fibres, stone fibres or any other suitable material that may strengthen the material.

The invention claimed is:

1. A sealing device for sealing fractures or leaks in a wall or formation surrounding a tube-shaped channel, the sealing device comprising:

an elongated body having a longitudinal direction and being configured to be introduced into the tube-shaped channel, the elongated body including a sealing fluid placement section arranged between a first and a second annular flow barrier configured to extend from a circumference of the elongated body to the wall or formation surrounding the tube-shaped channel, and the sealing fluid placement section including a sealing fluid outlet port, wherein the elongated body includes a sealing fluid activation section arranged between the second annular flow barrier and a third annular flow barrier configured to extend from a circumference of the elongated body to the wall or formation surrounding the tube-shaped channel, and the sealing fluid activation section includes a sealing fluid activation device configured to at least initiate or accelerate curing of the sealing fluid.

2. A sealing device according to claim 1, wherein the first, second and third annular flow barriers are configured to at least partly seal the respective circumference of the elongated body against the wall or formation surrounding the tube-shaped channel.

3. The sealing device according to claim 1, wherein the sealing fluid activation device is configured to at least initiate curing of the sealing fluid via electromagnetic or particle radiation, wherein the sealing fluid activation device includes a neutron accelerator configured to cause secondary gamma radiation in the wall or formation surrounding the tube-shaped channel, and wherein a plug or seal configured to shield against radiation is positioned in the elongated body of the sealing device in an area at the transition between the sealing fluid placement section and the sealing fluid activation section.

4. The sealing device according to claim 1, wherein at least one of the annular flow barriers includes an expandable seal in the form of a hollow elastic ring configured to be inflated by an inflation fluid, wherein the expandable seal is configured to be transformable between a first, retracted configuration, a second expanded configuration, and a third expanded configuration, wherein, in both the second and third expanded configurations, the expandable seal extends further away from the circumference of the elongated body than it does in the retracted configuration, and wherein the sealing device is configured to apply a greater expansion force to the expandable seal in the third expanded configuration than in the second expanded configuration.

5. The sealing device according to claim 1, wherein at least one of the annular flow barriers includes an elastic flange extending out from a circumference of the elongated body and having a radially outer edge configured to scrape against the wall or formation surrounding the tube-shaped channel, and wherein when viewed in an axial section, the elastic flange extends in an oblique direction in relation to the longitudinal direction of the elongated body of the sealing device.

6. The sealing device according to claim 5, wherein the radially outer edge of the elastic flange is adjustable between a retracted position and an expanded position via a slider displaceable in the longitudinal direction of the elongated body and connected to the elastic flange.

7. The sealing device according to claim 1, wherein at least one of the annular flow barriers includes two elastic flanges each extending out from a circumference of the elongated body in an oblique direction in relation to the longitudinal direction of the elongated body of the sealing device, wherein the two elastic flanges have radially outer edges positioned against each other so that the two elastic flanges are reversed in relation to each other, and wherein said radially outer edges of the two elastic flanges are configured to scrape against the wall or formation surrounding the tube-shaped channel.

8. The sealing device according to claim 1, wherein the elongated body includes a cross flow shunt tube having a first end opening positioned outside the first annular flow barrier in relation to the sealing fluid placement section and a second end opening positioned outside the third annular flow barrier in relation to the sealing fluid activation section.

9. The sealing device according to claim 1, wherein the sealing fluid placement section includes a pressure gauge and a temperature gauge arranged between the first and second annular flow barriers, wherein the sealing fluid activation section includes a pressure gauge and a temperature gauge arranged between the second and third annular flow barriers, wherein a pressure gauge and a temperature gauge are arranged outside the first annular flow barrier in relation to the sealing fluid placement section, and wherein a pressure gauge and a temperature gauge are arranged outside the third annular flow barrier in relation to the sealing fluid activation section.

10. The sealing device according to claim 1, wherein the elongated body of the sealing device includes a recirculation port positioned outside the part of the elongated body isolated by the first and third annular flow barriers, and wherein the recirculation port is configured for recirculation of fluids including sealing fluid through the tube-shaped channel.

11. The method according for sealing fractures or leaks in a wall or formation surrounding a tube-shaped channel, the method comprising:

introducing the sealing device according to claim 1 into the tube-shaped channel;

ejecting sealing fluid from the sealing fluid placement section through the sealing fluid outlet port into the tube-shaped channel to displace the sealing device along the tube-shaped channel until the sealing fluid activation section of the elongated body is placed at a position where sealing fluid has been ejected by the sealing fluid placement section; and activating the sealing fluid activation device of the sealing fluid activation section to thereby initiate or accelerate, via irradiation, curing of the ejected sealing fluid.

12. A method for sealing fractures or leaks in a wall or formation surrounding a tube-shaped channel comprising:

introducing an elongated body having a longitudinal direction into the tube-shaped channel, whereby a sealing fluid placement section of the elongated body is arranged between a first and a second annular flow barrier extending from a circumference of the elongated body to the wall or formation surrounding the tube-shaped channel; and ejecting sealing fluid from the sealing fluid placement section through a sealing fluid outlet port into the tube-shaped channel, wherein a sealing fluid activation section is arranged between the second annular flow barrier and a third annular flow barrier extending from a circumference of the elongated body to the wall or formation surrounding the tube-shaped channel, by that the elongated body is displaced along the tube-shaped channel until the sealing fluid activation section of the elongated body is placed at a position where sealing fluid has been ejected by the sealing fluid placement section, and by that a sealing fluid activation device of the sealing fluid activation section is activated, whereby curing of the ejected sealing fluid is at least initiated or accelerated via irradiation of the sealing fluid.

13. The method according to claim 12, whereby the first, second and third annular flow barriers are at least partly sealing the respective circumferences of the elongated body against the wall or formation surrounding the tube-shaped channel.

14. The method according to claim 12, whereby, before initiation or acceleration of the curing of the ejected sealing fluid, the elongated body is displaced along the tube-shaped channel until the sealing fluid activation section of the elongated body is placed at the position where the sealing fluid placement section was placed during ejection of the sealing fluid, and whereby curing of the ejected sealing fluid is at least almost finished before the sealing fluid activation section of the elongated body is removed from the position where the sealing fluid placement section was placed during ejection of the sealing fluid.

15. The method according to claim 12, whereby the elongated body is displaced along the tube-shaped channel in a stepwise manner in such a way that in a first step, the elongated body is displaced to a certain position along the tube-shaped channel and arrested there during ejection of sealing fluid into the tube-shaped channel, and in a second step, the elongated body is displaced to another position along the tube-shaped channel and arrested there during activation via the sealing fluid activation section of the sealing fluid that has been ejected by the sealing fluid placement section, and whereby these two steps are repeated several times.

16. The method according to claim 12, whereby at least one of the annular flow barriers includes an expandable seal configured to be inflated by an inflation fluid, whereby, during introduction of the elongated body into the tube-shaped channel and during displacement of the elongated body until the sealing fluid placement section of the elongated body is placed at a position where sealing fluid is to be ejected, the pressure of the inflation fluid is maintained below a first inflation pressure so that the expandable seal adopts a first, retracted configuration, whereby, subsequently to ejecting the sealing fluid into the tube-shaped channel, during displacement of the elongated body along the tube-shaped channel until the sealing fluid activation section of the elongated body is placed at a position where sealing fluid has been ejected by the sealing fluid placement section, the pressure of the inflation fluid is maintained above a second inflation pressure greater than the first inflation pressure so that the expandable seal adopts a second expanded configuration so that the expandable seal scrapes along the wall or formation surrounding the tube-shaped channel, and whereby, at least during ejection of the sealing fluid, the pressure of the inflation fluid is maintained above a third inflation pressure greater than the second inflation pressure so that the expandable seal adopts a third expanded configuration in which the expandable seal seals a circumference of the elongated body against the wall or formation surrounding the tube-shaped channel to a greater extent than when the expandable seal adopts the second expanded configuration.

17. The method according to claim 12, whereby the elongated body is displaced along the tube-shaped channel in a continuous manner during ejection of sealing fluid into the tube-shaped channel via the sealing fluid placement section and during simultaneous activation via the sealing fluid activation section of sealing fluid previously ejected by the sealing fluid placement section, and whereby at least the second annular flow barrier scrapes against the wall or formation surrounding the tube-shaped channel during ejection of sealing fluid.

18. The method according to claim 12, whereby a section of the tube-shaped channel is treated two or more times by a sequence including sealing fluid ejection and subsequent sealing fluid activation, whereby in between or before said sequences, the tube-shaped channel is flushed via a fluid suitable to remove loose solid parts, and whereby before the first of said sequences, the tube-shaped channel is pre-flushed with solvents.

19. The method according to claim 12, whereby, after or during ejection of sealing fluid from the sealing fluid placement section, a first test pressure is measured in the tube-shaped channel at the sealing fluid placement section between the first and second annular flow barrier and at least one second test pressure is measured outside the first and/or the second annular flow barrier, whereby said test pressure is compared with a reference pressure or whereby a difference between the first test pressure and the second test pressure is compared with a reference pressure differential, and whereby subsequent activation via the sealing fluid activation section of the sealing fluid that has been ejected by the sealing fluid placement section is not performed before measurement of a test pressure that is higher than the reference pressure or measurement of a test pressure difference that is higher than the reference pressure differential.

20. The method according to claim 12, whereby an activation fluid or substance is embedded into, mixed with or contained by the sealing fluid as the sealing fluid is ejected by the sealing fluid placement section, whereby the activation fluid or substance is released for contact with the sealing fluid by activation of the sealing fluid activation device, whereby before activation, particles having a protective outer layer or coating enclosing the activation fluid or substance are provided, whereby before activation, particles having a protective outer layer or coating enclosing the sealing fluid are provided, and whereby said protective outer layer or coating is disintegrated via the sealing fluid activation device by the action of one or more of: thermal radiation, electromagnetic radiation, particle radiation, solvent dissolution, and a substance provided by the sealing fluid activation device.

* * * * *